US009637964B1

(12) United States Patent
Kun

(10) Patent No.: US 9,637,964 B1
(45) **Date of Patent: *May 2, 2017**

(54) CUPBOARD WITH UP-DOWN LOUVERED DOOR AND BALANCE SYSTEM

(71) Applicant: Cmech (Guangzhou) Ltd., Guangdong (CN)

(72) Inventor: Ding Gou Kun, Guangdong (CN)

(73) Assignee: Cmech (Guangzhou) Ltd., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,021

(22) Filed: Jul. 15, 2016

(30) Foreign Application Priority Data

Dec. 29, 2015 (CN) ..... 2015 1 1022631

(51) Int. Cl.
*A47B 97/00* (2006.01)
*E05D 15/26* (2006.01)
(Continued)

(52) U.S. Cl.
CPC ..... *E05D 15/262* (2013.01); *A47B 95/02* (2013.01); *A47B 96/00* (2013.01); *E05D 13/14* (2013.01); *E05D 15/165* (2013.01); *E05F 11/54* (2013.01); *E05F 15/605* (2015.01); *E05F 15/665* (2015.01); *E06B 3/928* (2013.01);
(Continued)

(58) Field of Classification Search
CPC ..... E06B 9/302; E06B 3/483; E06B 3/928; E06B 9/0638; E06B 9/0676; Y10S 160/901; E05Y 2900/132; E05Y 2900/20; E05D 13/14; E05D 15/582; A47B 97/00
USPC ..... 160/189, 190, 201, 207; 312/319.5–319.8, 297, 325; 49/82.1, 49/86.1, 90.1
See application file for complete search history.

(56) References Cited

U.S. PATENT DOCUMENTS 702,148 A * 6/1902 McCloud ..... E06B 7/084 49/403
799,398 A * 9/1905 McMullen ..... E06B 3/481 160/159
(Continued)

FOREIGN PATENT DOCUMENTS

CA 1108198 * 9/1981
DE 4020334 * 1/1992
(Continued)

OTHER PUBLICATIONS

Translation for EP 2248983.*

*Primary Examiner* — Janet M Wilkens
(74) *Attorney, Agent, or Firm* — McKee, Voorhees & Sease, PLC

(57) ABSTRACT

A cupboard has an up-down louvered door. Wherein the door comprises a plurality of louvers, and a lift rack in which the louvers are configured. When people need to open the door, the lift rack lifts and folds up, causing the louvers to fold up, and thus the door is opened; and when people need to close the door, the lift rack descends and extends, causing the louvers to extend, and thus the door is closed. The door can open adequately so as to facilitate taking out/putting in articles. No more space is occupied while opening the door, and the door is safe when closing. A small driving force can open/close the door, and the cupboard features easy operation, long lifetime, low cost and good stability.

24 Claims, 8 Drawing Sheets

(51) Int. Cl.

| | |
|---|---|
| ***A47B 96/00*** | (2006.01) |
| ***A47B 95/02*** | (2006.01) |
| ***E06B 7/082*** | (2006.01) |
| ***E05F 11/54*** | (2006.01) |
| ***E05D 15/16*** | (2006.01) |
| ***E06B 3/92*** | (2006.01) |
| ***E06B 5/00*** | (2006.01) |
| ***E05D 13/00*** | (2006.01) |
| ***E05F 15/605*** | (2015.01) |
| ***E05F 15/665*** | (2015.01) |

(52) U.S. Cl.
CPC ..... *E06B 5/006* (2013.01); *E06B 7/082* (2013.01); *E05Y 2900/20* (2013.01)

(56) References Cited

U.S. PATENT DOCUMENTS 1,709,872 A * 4/1929 Peelle ..... E05D 13/14 160/189
1,832,966 A * 11/1931 Cook ..... E06B 3/925 160/138
1,892,340 A * 12/1932 Guth ..... E06B 3/483 160/147
1,965,262 A * 7/1934 Seregi ..... E06B 9/302 160/165
2,237,800 A * 4/1941 Webber ..... E06B 9/302 160/172 R
2,389,956 A * 11/1945 Castilonia ..... E06B 9/302 160/172 R
2,621,723 A * 12/1952 Etten ..... E06B 9/302 160/168.1 R
2,672,928 A * 3/1954 King, Jr. ..... E04F 10/10 160/172 R
2,688,365 A * 9/1954 Garubo ..... E06B 3/928 160/172 R
2,760,566 A * 8/1956 Nicolas ..... E06B 9/302 160/168.1 R
3,008,519 A * 11/1961 Hawkins ..... B60J 1/2088 160/169
3,304,994 A * 2/1967 Kozak ..... E06B 3/925 160/193
3,378,059 A * 4/1968 Young ..... E06B 3/483 160/165
5,062,464 A * 11/1991 Peterson ..... E06B 3/94 160/138
5,163,494 A * 11/1992 MacNeil ..... E06B 3/928 160/188
5,170,108 A * 12/1992 Peterson ..... E06B 9/32 160/168.1 P
5,893,403 A * 4/1999 Megens ..... E05D 15/262 160/207
5,934,776 A * 8/1999 Motta ..... E06B 9/115 109/15
5,983,971 A * 11/1999 Miller ..... E06B 9/0638 160/170
6,145,568 A * 11/2000 Lundstrom ..... E06B 9/0692 160/189
6,311,757 B1 * 11/2001 Schuette ..... E06B 9/0638 160/189
6,953,074 B2 * 10/2005 Cardinal ..... E06B 9/0676 160/168.1 R
7,156,142 B2 * 1/2007 Peterson ..... E06B 3/928 160/138
8,302,654 B2 * 11/2012 McDonald ..... E06B 9/0638 160/193
8,555,948 B2 * 10/2013 Park ..... E06B 7/086 160/172 R
9,267,320 B2 * 2/2016 Kitterman ..... E05F 17/00
2005/0126721 A1 * 6/2005 Fan ..... E05D 15/165 160/201
2010/0072868 A1 * 3/2010 Deem ..... E06B 3/925 312/319.7

FOREIGN PATENT DOCUMENTS

DE 202010011321 U1 12/2010
EP 2248983 * 11/2010
EP 2586956 * 5/2013

* cited by examiner

CUPBOARD WITH UP-DOWN LOUVERED DOOR AND BALANCE SYSTEM

35 U.S.C. §119 CLAIM FOR PRIORITY

This application claims priority to Chinese Application Serial No. 201511022631.4, filed on Dec. 29, 2015.

FIELD OF THE INVENTION

The present invention relates to a cupboard with an up-down louvered door.

BACKGROUND OF THE INVENTION

A cupboard is used for storage, for example, a clothes cupboard, a kitchen cupboard, and a shoes cupboard. A cupboard is usually equipped with a door. People can open the door to take articles out, and close the door for preventing articles inside the cupboard from falling, from humidification, and hiding the articles so as to have a good appearance.

However some inconveniences may be encountered while using a cupboard, for example:

1. When the door is configured as a horizontal slide door, there are usually two slide doors, i.e. a left door and a right door. The left door can be pushed to right side, so that articles can be taken out from left side of the cupboard, or the right door can be pushed to the left side, so that articles can be taken out from the right side of the cupboard. However it is impossible to place a big article into a center of cupboard unless both the left and right doors were removed.

When the door is configured as a swing door, people can place a big article into the center of cupboard, but the door must require a certain space for opening. However in a small space, the door may open at a small or limited angle, thus causing difficulty to take out/put in articles in the cupboard.
2. Some prior art doors may be difficult to open, and need a great strength to open the door. Therefore some driving devices were installed in the door. Chinese patent CN203654983U provided a device to open/close a door, in which a motor is equipped, and the door can be opened/closed by controlling a forward-rotation/rearward-rotation of the motor. Although this method can solve the problem as to how to open/close the door without too much strength, some drawbacks exist, for example:
   a) The strength to open the door is not always constant, sometimes more strength is needed, but sometimes smaller. If the door is driven by a constant power of the motor, the door may be more easily damaged;
   b) If the power of the motor must be controlled in order to open the door smoothly, a complex motor control system with high cost will be required;
   c) If the door needs more strength, a more powerful motor will also be required, at increased cost for the motor.

Therefore, a primary objective of the present invention is the provision of an improved cupboard door closer which overcomes the problems of the prior art.

Another objective of the present invention is the provision of a door closer having a counter-balance to assist in opening and closing of a vertically moveable door.

A further objective of the present invention is a motorized door closer for a cupboard door.

SUMMARY OF THE INVENTION

Therefore, it is desirable to provide a cupboard with an up-down, vertically movable louvered door. The door can open adequately so as to facilitate taking out/putting in articles. No more space is occupied or needed while opening the door, and the door is safe while closing.

The present invention is therefore provided as follows:

A cupboard with up-down louvered door, comprises a cupboard body or box, a door configured in the body, wherein the door comprises a plurality of louvers, and lift racks in which the louvers are configured or mounted to. When people need to open the door, the lift racks lift and fold up, causing the louvers to fold up, and thus the door is open; and when people need to close the door, the lift racks descend and extend, causing the louvers to extend, and thus the door is closed.

In some embodiments, each lift rack comprises a plurality of first lift units, and a plurality of second lift units in which each second lift unit is connected to two adjacent first lift units; and the louvers are connected to the first lift units, that is, each louver is secured to each corresponding first lift unit.

Further each first lift unit comprises a first connective element or finger securing to the louver, and a second connective element hinged to the first connective element; and each second lift unit comprises a third connective element hinged to the first connective element, and a fourth connective element hinged to the second connective element. The third connective element and the fourth connective element are hinged together. These connective elements form a scissors-type jack assembly.

Further, a guide protrusion is set up on the first connective element; a guideway is configured in the body, for installing the lift rack therein; and a guide groove is configured in the guideway, for restricting the guide protrusion to move therein.

Further, a mounting slot is configured at a left board of the body, and another mounting slot is configured at a right board of the body.

In some embodiments, the cupboard includes a balance system comprising a transmission shaft, a first pulley configured at the transmission shaft, and a balance or counter-weight component.

A first pulley is mounted on the shaft and is connected to a rack belt. One end of the first belt is secured to the first pulley, and the other end of the rack belt is connected to the lift rack.

The balance component comprises a counter-weight balancing member, a balancing belt and a second pulley on the transmission shaft. One end of the balancing belt is connected to the second pulley, and the other end of the balancing belt is connected to the balancing weight member, such that the balancing member can be hung on the second pulley.

The first pulley and the second pulley rotate synchronously, and the rack belt and the balancing belt are wound inversely on the first and second pulleys, respectively.

In some embodiments, the balance system includes a motor transmission apparatus, comprising a reversible electric motor, a first gear coaxially connected to the motor, and a second gear secured to the transmission shaft; with the first gear in meshing engagement with the second gear.

In some embodiments, an electric/manual switch is configured on the motor, for enabling the first gear and the second gear to be disengaged/engaged.

Further the second gear is arranged at a center of the transmission shaft.

In some embodiments, the cupboard comprises a plurality of regulating wheels for tightening/releasing the belt, and the regulating wheels are configured at the left and right boards.

The present invention can bring the following benefits:

For the cupboard with an up-down louvered door in the present invention, the door can open adequately so as to facilitate taking out/putting in articles since the lift racks lift and fold up, causing the louvers to fold up. In addition, no more space is occupied while opening the door, and the door is safe while closing.

Further the transmission shaft is equipped with a balance component, the pulling force or weight of the door corresponds to the pulling force or weight of the balancing member, so as to make the balance system in a balanced state. A small driving force can provide a system imbalance and drive the door opening/closing.

Further the balance component features simple structure, good stability and long lifetime, and can keep the door opening/closing smoothly.

Further the present invention also includes the motor transmission apparatus, an electric/manual switch is configured therein, to make the first gear and the second gear to be disengaged/engaged. Thus the door can open/close manually or electrically. Meanwhile, since a balance component is introduced herein, only a small power output of the motor is required, causing the total costs to be lower.

DETAILED DESCRIPTION OF THE PREFERRED EMBODIMENTS

Figure 1:
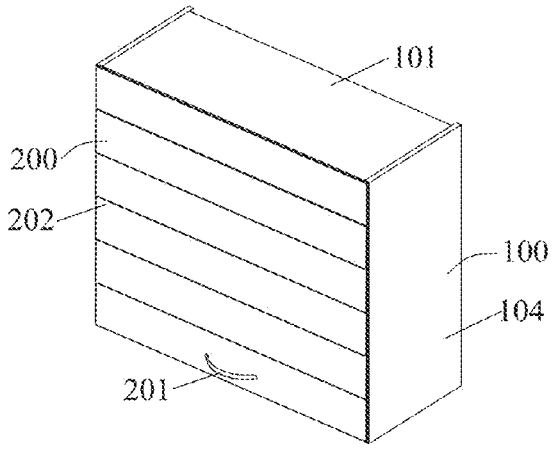
FIG. 1 is a structural schematic view of a cupboard according to the present invention, with the door closed.
Figure 2:
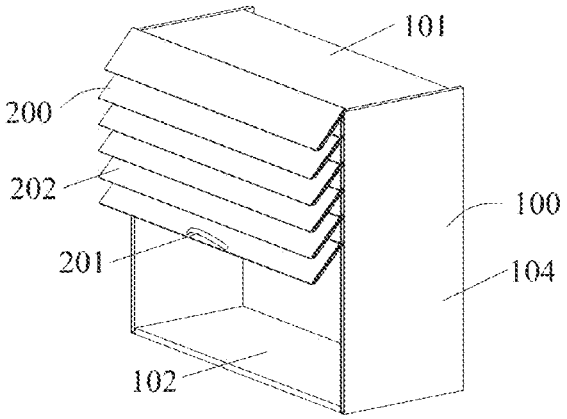
FIG. 2 is a structural schematic view of a cupboard according to the present invention, with the door partially opened.
Figure 3:
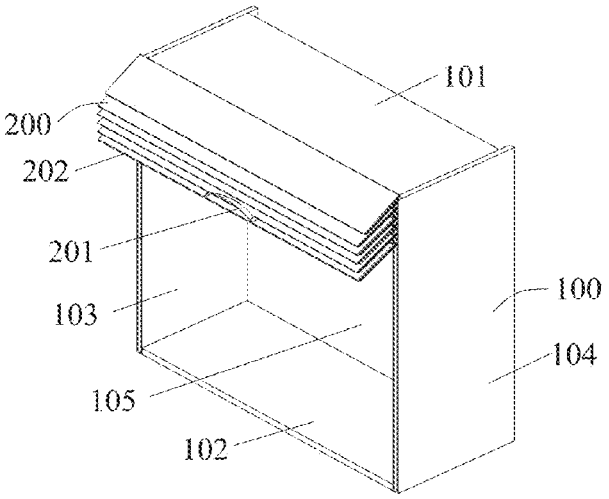
FIG. 3 is a structural schematic view of a cupboard according to the present invention, with the door opened fully.

The present invention will be described hereinafter in details with reference to the FIGS. 1-12.

Embodiment 1

A cupboard with up-down louvered door is shown in FIGS. 1-12.

The cupboard with up-down louvered door comprises a cupboard body or box 100 with an open front, a door 200 on the body 100 movable between a raised open position and a lowered closed position, and a handle 201 mounted on the door 200.

The door 200 adopts a lift louvered mechanism, comprising a plurality of louvers 202, a pair of lift racks 300, and a guideway 400 for each lift rack 300.

Each of the lift racks 300 comprises a plurality of first lift units 310, and a plurality of second lift units 320 in which each second lift unit 320 is connected to two adjacent first lift units 310. Each louver 202 is secured to each corresponding first lift unit 310.

Each first lift unit 310 comprises a first connective element or finger 311 securing to the louver 202, and a second connective element 312 hinged to the first connective element 311. Each second lift unit 320 comprises a third connective element 321 hinged to the first connective element 311, and a fourth connective element 322 hinged to the second connective element 312. Both the third connective element 321 and the fourth connective element 322 are hinged to each other. Thus, the elements 311, 312, 321, 322 form a scissor jack type assembly.

As shown in FIGS. 1-4, the cupboard has a door containing multiple louvers 202 which are secured onto the first lift units, 310 respectively, by any convenient means such as a strong adhesive, snap-fitting or port connection or the like. More particularly, each louver 202 is secured onto each corresponding first connective element 311 such that the louvers 202 can be mounted to the lift racks 300.

Figure 7:
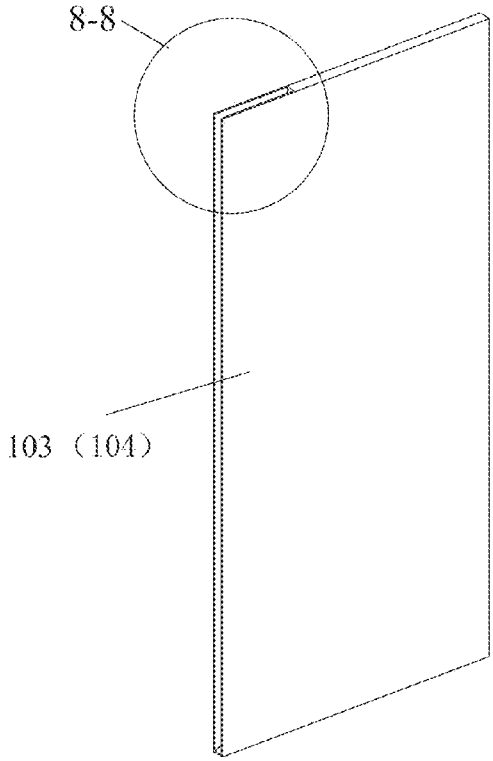
FIG. 7 is a structural schematic view of a left/right side board of the cupboard.
Figure 8:
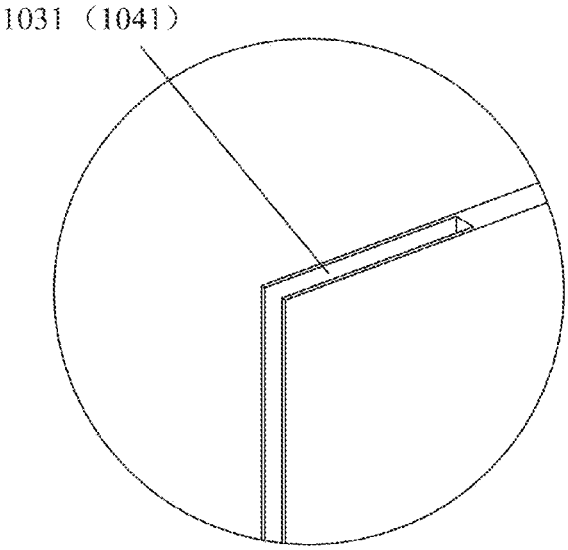
FIG. 8 is an enlarged view of the portion "8-8" in FIG. 7.
Figure 9:
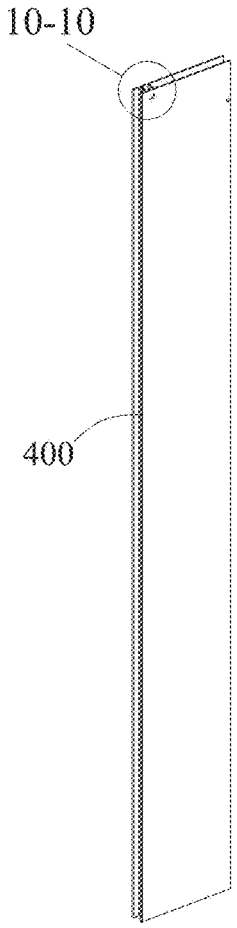
FIG. 9 is a structural schematic view showing a guideway for the lift rack.

The body 100 consists of a top board 101, a bottom board 102, a left board 103, a right board 104 and a rear board 105. As shown in FIGS. 7-9, a mounting slot 1031 is configured at the left board 103, and a mounting slot 1041 is configured at the right board 104. Two guideways 400 are mounted inside the mounting slots 1031 and 1041, respectively, with each lift rack 300 connected to each guideway 400.

Figure 6:
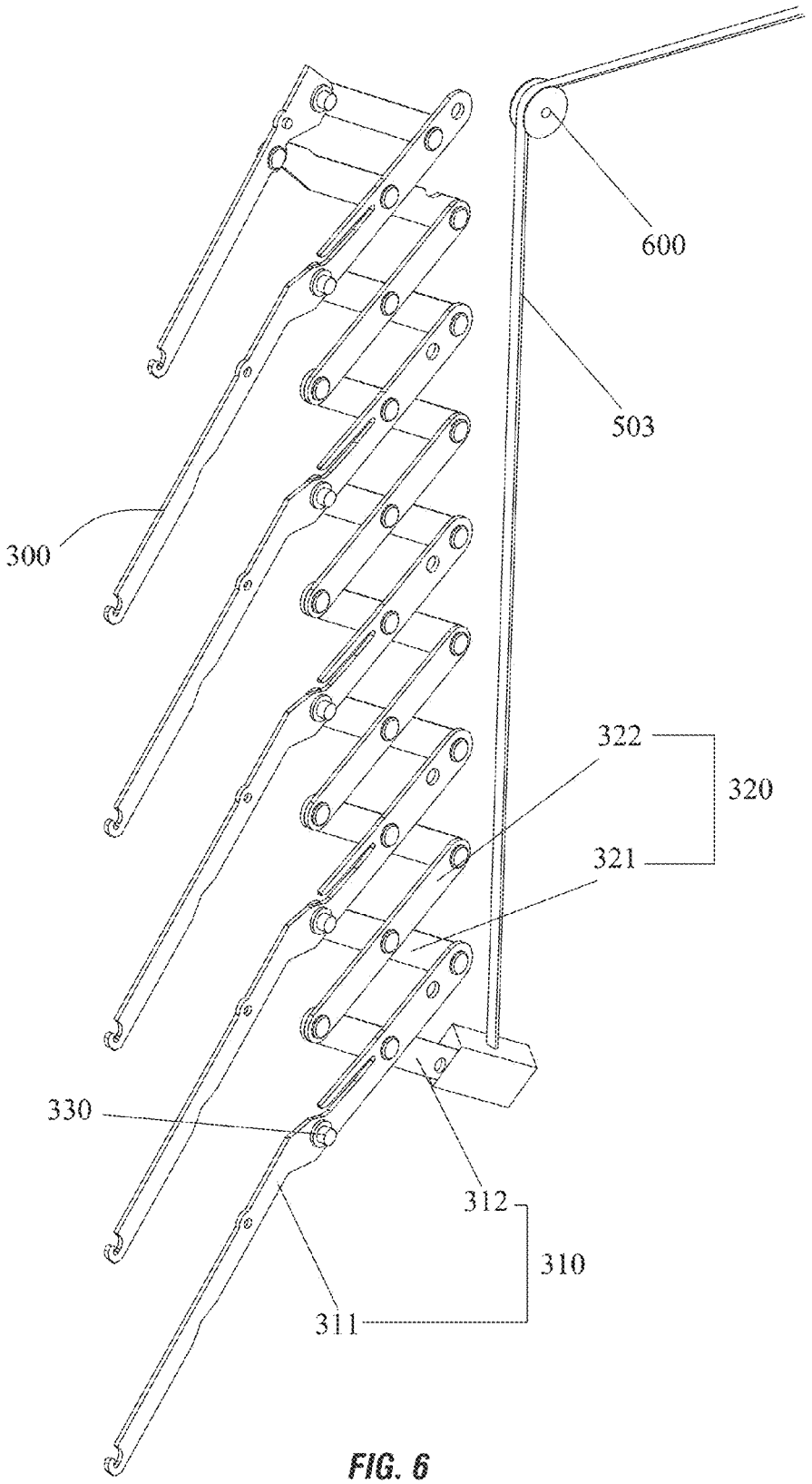
FIG. 6 is a structural schematic view of one of the lift racks.
Figure 10:
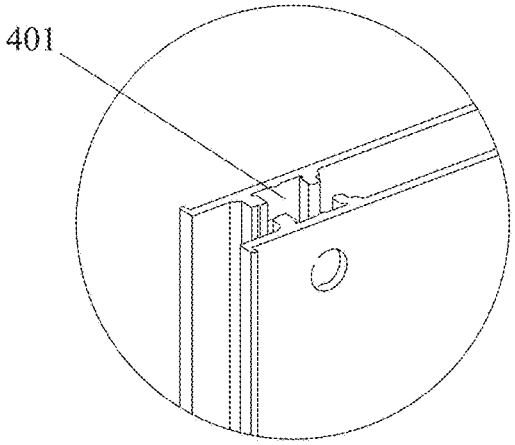
FIG. 10 is an enlarged view of the portion "10-10" in FIG. 9.

As shown in FIGS. 6 and 10, a guide protrusion 330 extends from the first connective element 311, and a guide groove 401 is provided in the guideway 400. The guide protrusion 330 can only be moved in the guideway 400 such that the lift rack 300 can lift and fold up, or, descend and extend, along the guide groove 401.

When people need to open the door 200, the lift racks 300 lift and fold up, causing the louvers 202 to fold up, the door is thus open.

When people need to close the door 200, the lift racks 300 descend and extend, causing the louvers 202 to extend, the door is thus closed.

Therefore, for the cupboard with up-down louvered door in the present invention, the door can open adequately so as to facilitate taking out/putting in articles since the lift racks lift and fold up, causing the louvers to fold up. In addition, no more space is occupied while opening the door, and it would be safe while closing the door.

Embodiment 2

Figure 4:
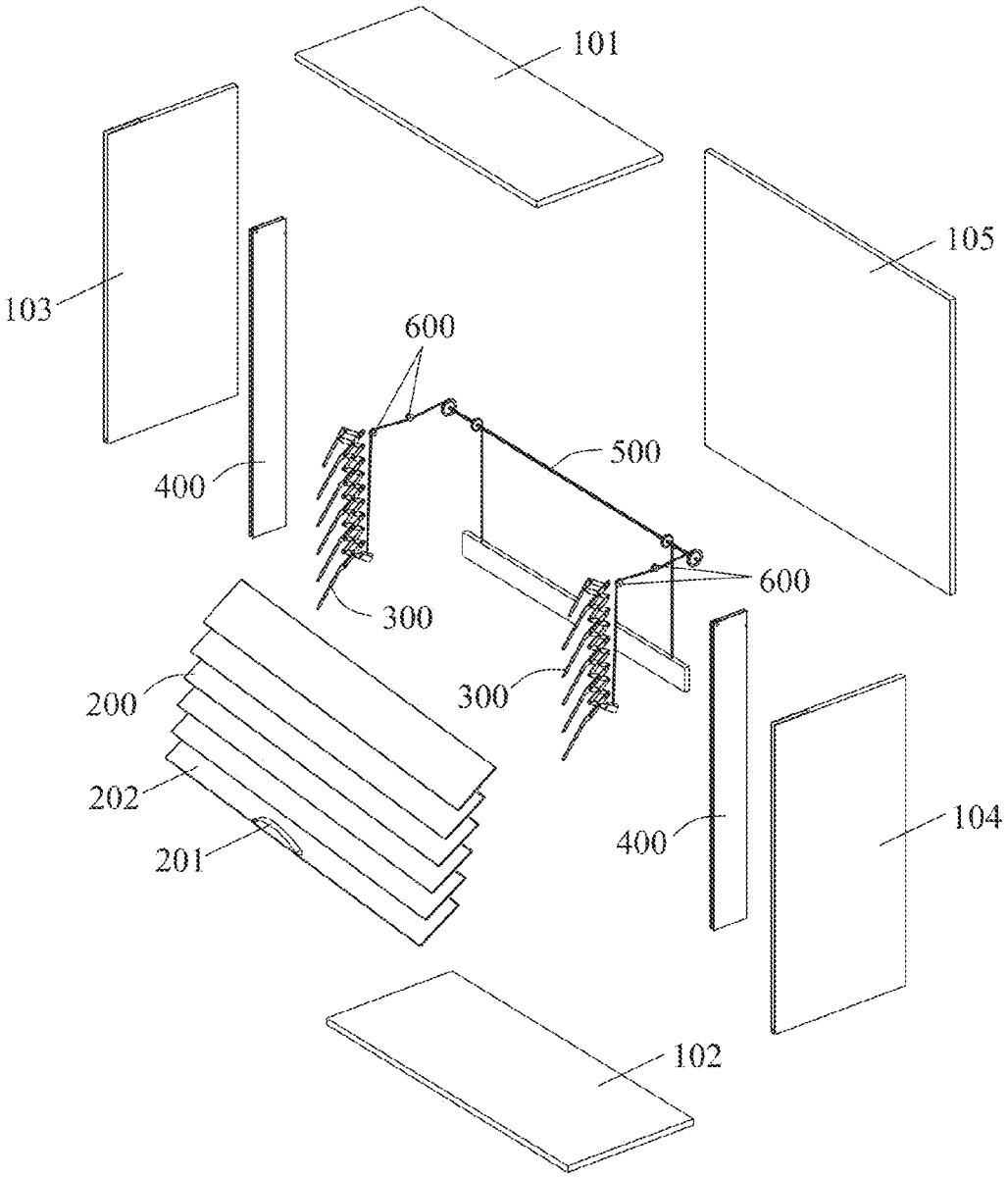
FIG. 4 is an exploded view of an embodiment of the cupboard, with the door partially opened.
Figure 5:
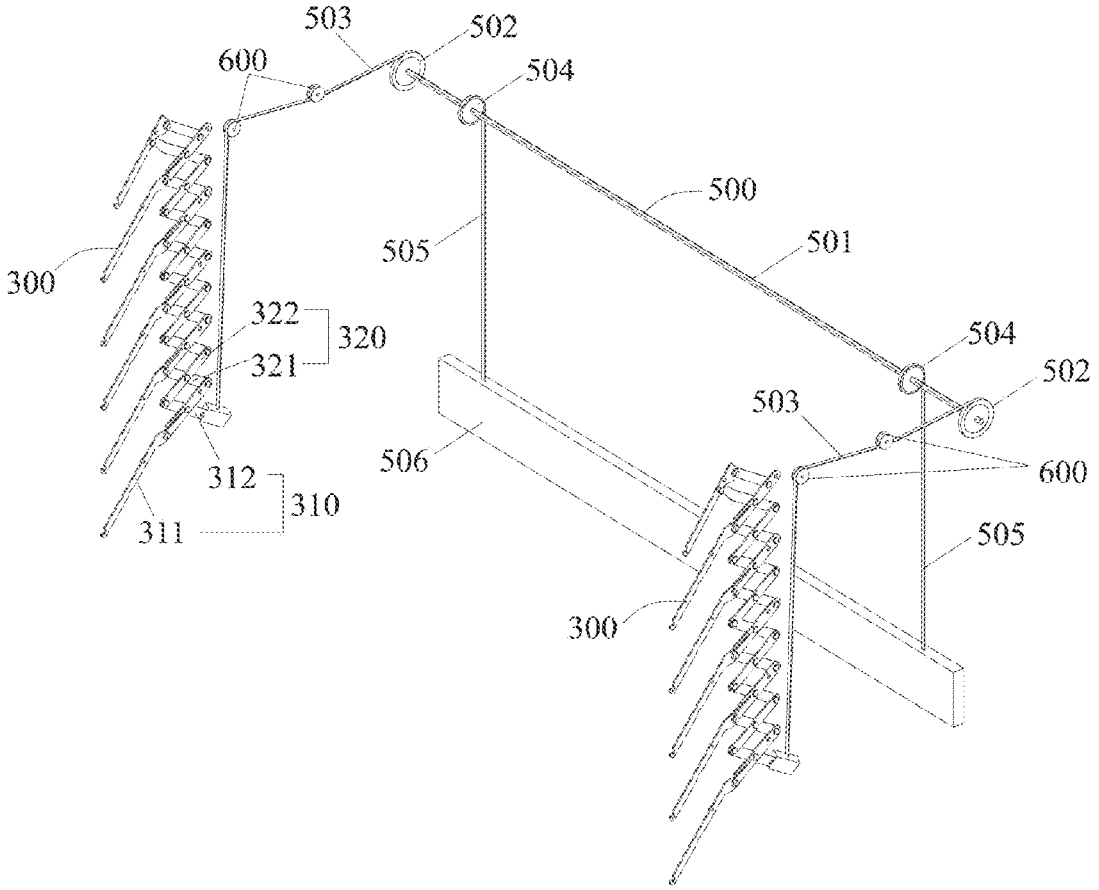
FIG. 5 is a structural schematic view showing the connection between lift racks and a balance system for the cupboard shown in FIG. 4.

In an alternative embodiment of the invention shown in FIGS. 4-5, the cupboard also includes a balance system 500 comprising a transmission shaft 501, a first pair of pulleys 502 on the transmission shaft 501, and a weight or balance component.

The first pair of pulleys 502 are connected to a pair of rack belts 503. One end of each rack belt 503 is secured to each pulley 502, and the other end of each rack belt 503 is connected to the lift racks 300, specifically to the second connective element 312 which is located at a lowest end of the lift racks 300, such that the door 200 is connected to the rack belts 503, and provides the rack belts 503 with a pulling force due to the weight of the door 200.

The balance component comprises a balancing member or weight 506, a pair of balancing belts 505 and a second pair of pulleys 504 on the transmission shaft 501. One end of each of the balancing belts 505 are connected to the second pulleys 504, and the other end of each of the balancing belts 505 is connected to the balancing member 506, such that the balancing member 506 can be hung on the second pulleys 504, and provides the balancing belts 505 with a pulling force due to the weight of the balancing member 506. The first pulleys 502, the second pulleys 504 and the transmission shaft 501 can rotate synchronously. The rack belts 503 and the balancing belts 505 are wound inversely on the first pulleys 502 and the second pulleys 504, respectively.

The pulling force from the door 200 corresponds to the pulling force from the balancing member 506 so as to make the balance system in a balanced state.

Further the cupboard comprises a plurality of regulating wheels 600 for tightening/releasing the belts 503, and the regulating wheels 600 are configured at the left and right boards.

The two second pulleys 504 are configured in bilateral symmetry at both sides of a center of the transmission shaft 501, and the elongated balancing member 506 is a homogeneous substance. Preferably the transmission shaft 501 and the elongated balancing member 506 have a same orientation, and both balancing belts 505 are mounted at both ends of the elongated balancing member 506 where two mounting points are in bilateral symmetry such that the force borne by both second pulleys 504 will be substantially identical.

The pulling force from the door 200 to the belts 503 corresponds to the pulling force from the balancing member 506 to the balancing belts 505 so as to make the balance system in a balanced state. A small driving force can make the system imbalance and facilitate the door opening/closing.

The present invention features simple structure, low cost, good stability and long lifetime.

Embodiment 3

Figure 11:
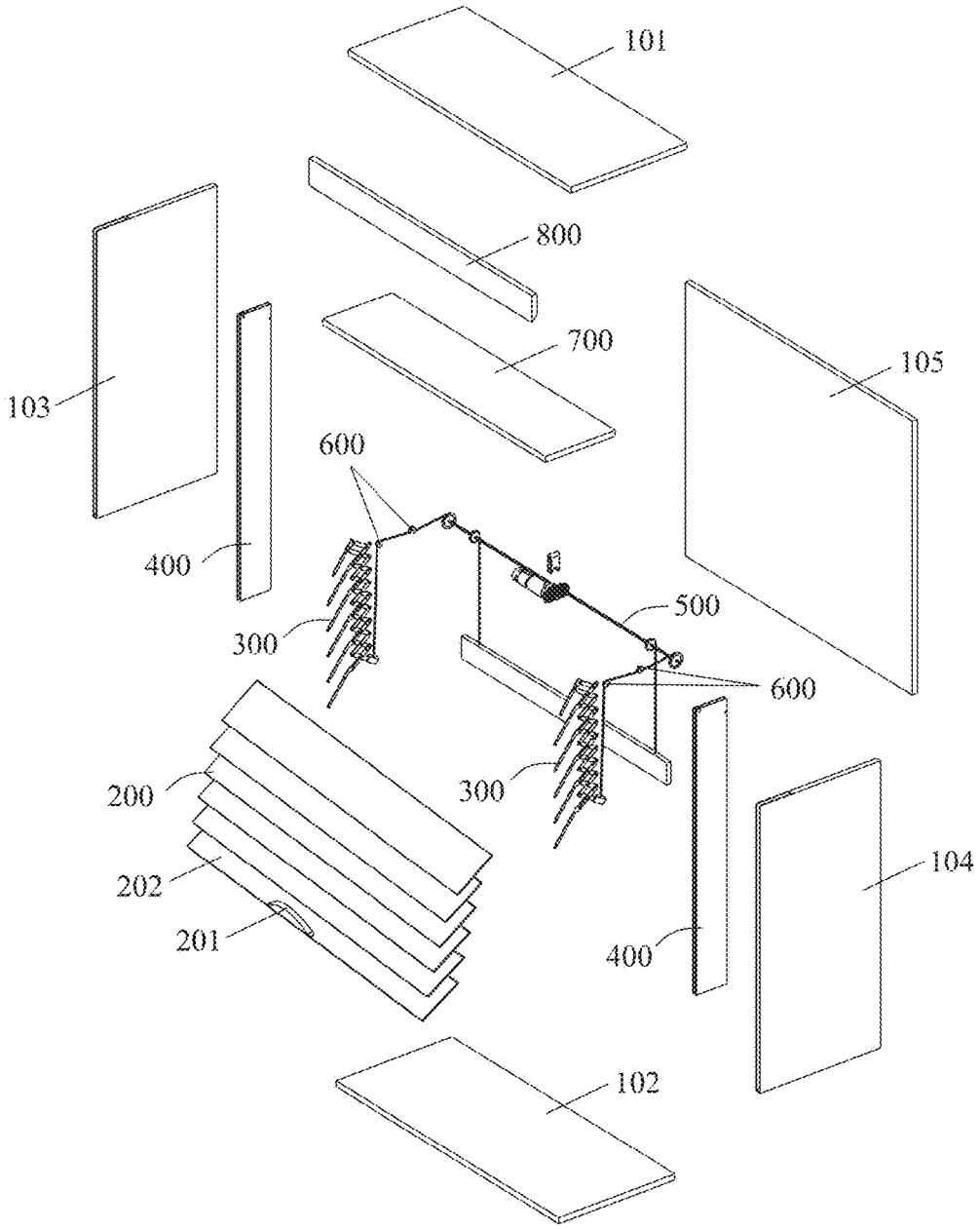
FIG. 11 is an exploded view of an alternative embodiment of a cupboard according to the present invention.
Figure 12:
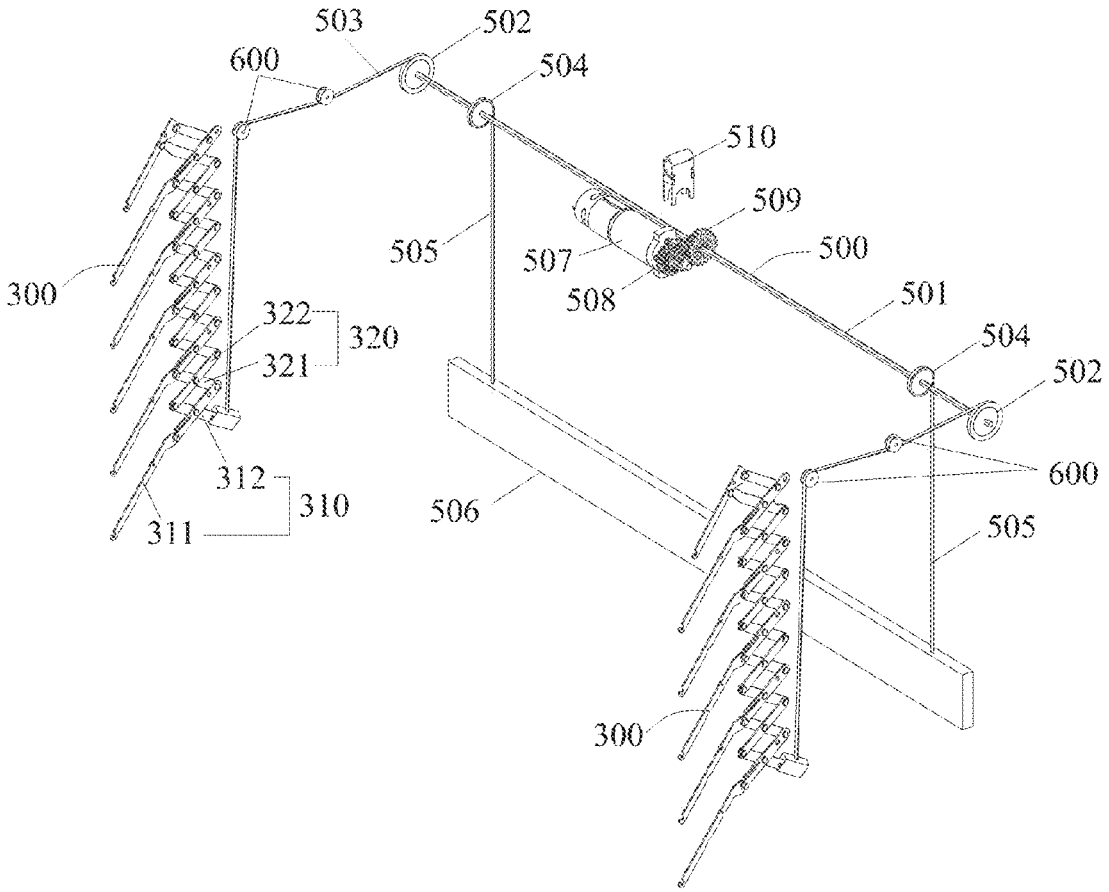
FIG. 12 is a structural view showing the connection between lift racks and a balance system for the cupboard shown in FIG. 11.

In another alternative embodiment shown in FIGS. 11-12, the cupboard also includes a motor transmission apparatus which is mounted in a mounting plate 700 located beneath the top board 101. A baffle plate 800 is also set up in the body 100.

The motor transmission apparatus comprises a motor 507, a first gear 508 coaxially connected to the motor 507, and a second gear 509 secured to the transmission shaft 501. The first gear 508 engages with the second gear 509. Preferably the second gear 509 is arranged at the center of the transmission shaft 501.

An electric/manual switch 510 is operatively connected to the motor 507, for enabling the first gear 508 and the second gear 509 to be disengaged/engaged. When the first gear 508 and the second gear 509 are disengaged, the balance system will be in a manual state, wherein a small driving force to the handle, places the system in imbalance to open/close the door.

When the first gear 508 and the second gear 509 are engaged and the motor 507 is powered up to rotate, the transmission shaft 501 is rotated. The motor generates a small driving force which can make the system imbalance and open/close the door. Since only a small power output is required the motor 507 costs is minimized. The present invention features good stability and long lifetime due to a balanced configuration.

If no balancing member 506 is present, there is no pulling force from the balancing member 506 to balance the weight of the door 200. In this circumstance, when people need to open/close the door, the motor will supply a stronger pulling force with more motor power. In addition, a motor controller may be required to control the motor's output, making the door open/close smoothly, and it may require a complex transmission mechanism with a higher cost.

It is understood that the belts may also be any type of tension member, such as a rope, cord, chain, or cable.

The embodiments described hereinbefore is merely preferred embodiments of the present invention and not for purposes of any restrictions or limitations to the invention. It will be apparent that any non-substantive, obvious alterations or improvements by the technician of this technical field according to the present invention may be incorporated into ambit of claims of the present invention.

What is claimed is:

1. A cupboard with an up-down louvered door, comprising:

a cupboard body, a door configured in the body;

the door having a plurality of louvers, and a lift rack in which the louvers are mounted;

wherein when opening the door, the lift rack lifts and folds up, causing the louvers to fold up, and the door is open;

wherein when closing the door, the lift rack descends and extends, causing the louvers to extend, and the door is closed;

the lift rack comprising a plurality of first lift units, and a plurality of second lift units in which each is connected to two adjacent first lift units;

the louvers being connected to the first lift units, and each louver being secured to each corresponding first lift unit;

each of the first lift units comprising a first connective element securing to the louvers and a second connective element hinged to the first connective element; and each of the second lift units comprising a third connective element hinged to the first connective element and a fourth connective element hinged to the second connective element; both the third connective element and the fourth connective element being hinged to each other.

2. The cupboard of claim 1 wherein a guide protrusion is set up on the first connective element; a guideway is configured in the body, for installing the lift rack therein; and a guide groove is configured in the guideway, for restricting the guide protrusion to move therein.

3. The cupboard of claim 2 wherein a mounting slot is configured at a left board of the body, and another mounting slot is configured at a right board of the body.

4. The cupboard of claim 1 wherein the cupboard includes a balance system comprising a transmission shaft, a first pulley on the transmission shaft, and a balance component;

the first pulley is connected to a belt, one end of the belt is secured on the first pulley, and the other end of the belt is connected to the lift rack;

the balance component comprises a balancing member, a balancing belt and a second pulley configured at the transmission shaft; one end of the balancing belt is connected to the second pulley, and the other end of the balancing belt is connected to the balancing member, such that the balancing member can be hung on the second pulley; and the first pulley and the second pulley rotate synchronously, and the belt and the balancing belt are wound inversely.

5. The cupboard of claim 4 wherein the balance system includes a motor transmission apparatus, comprising a motor, a first gear coaxially connected to the motor, and a second gear secured to the transmission shaft; the first gear engages with the second gear.

6. The cupboard of claim 5 wherein an electric/manual switch is configured on the motor, for enabling the first gear and the second gear to be disengaged/engaged.

7. The cupboard of claim 6 wherein the second gear is arranged at a center of the transmission shaft.

8. The cupboard of claim 4 wherein the cupboard comprises a plurality of regulating wheels for tightening/releasing the belt, and the regulating wheels are configured at the left and right boards.

9. A cupboard, comprising;

a box with an open front;

a door mounted on the box for movement between a raised open position and a lowered closed position;

the door having a plurality of louvers;

a pair of racks adjacent opposite ends of the louvers to support the louvers;

a pulley system mounted to the box and to the racks;

a weight connected to the pulley system to counterbalance the door;

the pulley system including a shaft driven by a motor, a pair of door pullets mounted adjacent opposite ends of the shaft, a pair of weight pulleys mounted adjacent opposite ends of the shaft, a pair of door belts extending between the racks and the door pulleys and a pair of weight belts extending between the weight and the weight pulley; and the door belts wrapping around the door pulleys in a first direction and the weight belts wrapping around the weight pulleys in a second direction opposite the first direction.

10. The cupboard of claim 9 wherein the motor is a reversible motor connected to the pulley system to move the door between the open and closed positions.

11. The cupboard of claim 9 wherein each rack has a plurality of fingers, and each finger is attached to one end of one of the louvers.

12. The cupboard of claim 11 wherein each rack includes a scissors jack.

13. The cupboard of claim 9 wherein the motor has a drive gear and the pulley system has a drive gear in mesh with the drive gear.

14. The cupboard of claim 9 further comprises a track system to guide movement of the door.

15. The cupboard of claim 14 wherein the box includes opposite side walls, and the track system includes a channel in each sidewall and a protrusion on each rack received in the channel.

16. A cupboard with an up-down louvered door, comprising:

a cupboard body, with a door configured in the body;

the door having a plurality of louvers, and a lift rack in which the louvers are mounted;

wherein when opening the door, the lift rack lifts and folds up, causing the louvers to fold up, and the door is open;

wherein when closing the door, the lift rack descends and extends, causing the louvers to extend, and the door is closed;

the cupboard including a balance system comprising a transmission shaft, a first pulley on the transmission shaft, and a balance component;

the first pulley being connected to a belt, one end of the belt being secured on the first pulley, and the other end of the belt being connected to the lift rack;

the balance component comprising a balancing member, a balancing belt and a second pulley configured at the transmission shaft; one end of the balancing belt being connected to the second pulley, and the other end of the balancing belt being connected to the balancing member, such that the balancing member can be hung on the second pulley; and the first pulley and the second pulley rotate synchronously, and the belt and the balancing belt being wound inversely.

17. The cupboard on claim 16 wherein the lift rack comprising a plurality of first lift units, and a plurality of second lift units in which each is connected to two adjacent first lift units; and the louvers being connected to the first lift units, and each louver being secured to each corresponding first lift unit.

18. The cupboard of claim 17 wherein each of the first lift units comprising a first connective element securing to the louvers, and a second connective element hinged to the first connective element; and each of the second lift units comprising a third connective element hinged to the first connective element and a fourth connective element hinged to the second connective element; both the third connective element and the fourth connective element being hinged to each other.

19. The cupboard of claim 18 wherein a guide protrusion is set up on the first connective element; a guideway is configured in the body, for installing the lift rack therein; and a guide groove is configured in the guideway, for restricting the guide protrusion to move therein.

20. The cupboard claim 19 wherein a mounting slot is configured at a left board of the body, and another mounting slot is configured at a right board of the body.

21. The cupboard of claim 20 wherein the cupboard comprises a plurality of regulating wheels for tightening/releasing the belt, and the regulating wheels are configured at the left and right boards.

22. The cupboard of claim 16 wherein the balance system includes an motor transmission apparatus, comprising a motor, a first gear coaxially connected to the motor, and a second gear secured to the transmission shaft; the first gear engages with the second gear.

23. The cupboard of claim 22 wherein an electric/manual switch is configured on the motor, for enabling the first gear and the second gear to be disengaged/engaged.

24. The cupboard of claim 23 wherein the second gear is arranged at a center of the transmission shaft.

* * * * *